US011813632B2

(12) United States Patent
Schroer et al.

(10) Patent No.: US 11,813,632 B2
(45) Date of Patent: Nov. 14, 2023

(54) FILTERING FLUID DISPENSING DEVICE

(71) Applicant: DOW GLOBAL TECHNOLOGIES LLC, Midland, MI (US)

(72) Inventors: Daniel R Schroer, Saginaw, MI (US); Larry Dotson, Midland, MI (US); Michael F Heckert, Lake Orion, MI (US); Greg T Stewart, Midland, MI (US)

( * ) Notice: Subject to any disclaimer, the term of this patent is extended or adjusted under 35 U.S.C. 154(b) by 68 days.

(21) Appl. No.: 16/190,443

(22) Filed: Nov. 14, 2018

(65) Prior Publication Data

US 2019/0151872 A1 May 23, 2019

Related U.S. Application Data

(60) Provisional application No. 62/585,615, filed on Nov. 14, 2017.

(51) Int. Cl.
*B05B 7/12* (2006.01)
*B05B 1/30* (2006.01)
(Continued)

(52) U.S. Cl.
CPC ..... *B05B 7/1209* (2013.01); *B05B 1/3026* (2013.01); *B05B 7/0025* (2013.01);
(Continued)

(58) Field of Classification Search
CPC ... B05B 7/1209; B05B 7/0025; B05B 7/2497; B05B 7/0416; B05B 15/40;
(Continued)

(56) References Cited

U.S. PATENT DOCUMENTS 3,743,188 A * 7/1973 Wagner ..... B05B 9/01 239/575
5,333,790 A * 8/1994 Christopher ..... B05B 15/65 239/391
(Continued)

FOREIGN PATENT DOCUMENTS

CA 2319191 A1 6/2000
DE 2055936 A1 5/1972
(Continued)

OTHER PUBLICATIONS

International Search Report, dated Jan. 30, 2019, for corresponding International Application No. PCT/US2018/061016, filed on Nov. 14, 2018.

*Primary Examiner* — Christopher R Dandridge
*Assistant Examiner* — Juan C Barrera

(57) ABSTRACT

A fluid dispensing device has a spool valve in a dispenser housing with a spool in a spool housing and a spool wall around the spool housing with entrance and an exit openings defined therethrough; an entrance channel in the dispenser housing proximate to the spool wall entrance opening; a force applying element in the entrance channel that applies force against the spool wall with entrance and exit ends with the exit end proximate to the spool wall; a hose adapter fitting with an entrance end extending out from and an exit end extending into the entrance and contacting the force applying element with a flow passage extending through it; and fluid communication through the hose adapter fitting flow passage through the force applying element and into an entrance opening in the spool wall; where the force applying element defines a tortuous path through which fluid must travel.

18 Claims, 6 Drawing Sheets

(51) Int. Cl.

| | |
|---|---|
| ***B05B 7/00*** | (2006.01) |
| ***B05B 7/24*** | (2006.01) |
| ***B05B 15/40*** | (2018.01) |
| ***B05B 12/00*** | (2018.01) |
| ***B05C 17/00*** | (2006.01) |
| *B05B 7/04* | (2006.01) |

(52) U.S. Cl.
CPC ..... *B05B 7/2497* (2013.01); *B05B 12/002* (2013.01); *B05B 15/40* (2018.02); *B05C 17/002* (2013.01); *B05B 7/0416* (2013.01)

(58) Field of Classification Search
CPC ... B05B 1/3026; B05B 12/002; B05B 7/0408; B05B 7/02; B05B 7/0031; B05B 7/0043; B05B 7/0483; B05B 7/12; B05B 7/1218; B05B 7/1245; B05B 9/01; B05C 17/002; B29B 7/7438; B29B 7/7447; B29B 7/7404; B29B 7/325; B29B 7/7419; B29B 7/761; B29B 7/7409; B29B 7/7605; B29B 7/7615; B29B 7/7678
USPC ..... 239/398, 407, 429, 432, 462, 575
See application file for complete search history.

(56) References Cited

U.S. PATENT DOCUMENTS

| | | | | |
|---|---|---|---|---|
| 5,944,259 | A * | 8/1999 | Brown | F16K 5/04 239/414 |
| 6,021,961 | A | 2/2000 | Brown | |
| 2006/0208000 | A1 * | 9/2006 | Murray | B29B 7/7404 222/135 |
| 2017/0157628 | A1 | 6/2017 | Heckert et al. | |

FOREIGN PATENT DOCUMENTS

| | | |
|---|---|---|
| DE | 4232439 A1 | 4/1994 |
| EP | 2428260 A1 | 3/2012 |

* cited by examiner

FILTERING FLUID DISPENSING DEVICE

BACKGROUND OF THE INVENTION

Field of the Invention

The present invention relates to a fluid dispensing device that filters particulates from the incoming fluid.

Introduction

Dispensing devices such as spray guns are useful for dispensing pressurized fluids. Dispensing devices for dispensing reactive two-component fluids are particularly challenging in design because the reactive fluids must be kept separate until such time as they are dispensed and then they must be mixed and dispensed rapidly and the device must preclude leaking of the reactive components. One such reactive two-component system that utilizes a dispensing device is a two-part polyurethane foam formulation. Dispensing devices for two-part polyurethane foam formulations typically have two fluid inlets and an exit with a spray nozzle. Two chemical feeds, typically described as the A-side (isocyanate containing fluid) and B-Side (polyol containing side) feed into the dispensing device through separate fluid inlets and then are mixed just prior to expelling from the spray nozzle. The dispensing device typically has a triggered valve that starts and stops flow of the A-side and B-side feeds through the dispensing device when actuated.

One popular dispensing device for two-part polyurethane foam formulations is described in U.S. Pat. No. 5,944,259 (259). The dispensing device of '259 is a spray gun with a spool valve. The A-side and B-side fluids feed into the spray gun through separate entrance channels to the spool valve. The entrance channels comprise a hose adapter fitting and a force applying element between the hose adapter fitting and a wall around the spool of the spool valve. The hose adapter fitting applies force through the force applying element so as to press the spool valve wall against the spool of the spool valve to prevent leaking of fluid around the spool. When the trigger is actuated to turn the spool into an "open" configuration fluid is able to flow through the hose adapter fittings, through the force applying elements, through entrance holes in the spool wall and through the spool of the spool valve to reach a mixing nozzle through which the two fluids are mixed just prior to exiting the spray gun.

The present inventors have discovered a challenge with dispensing devices such as that described in U.S. Pat. No. 5,944,259 and further have discovered how to resolve those challenges with the present invention.

BRIEF SUMMARY OF THE INVENTION

The present inventors have discovered a challenge with dispensing devices, particularly with those of two-part polyurethane foam formulations. When particulates are present in one or more fluid flowing through the spool valve there tends to be a problem of the dispensing device plugging. The inventors have discovered that the A-side component of a two-part polyurethane formulation can develop crystals when stored at temperatures of 4.4 degrees Celsius (° C.), 40 degrees Fahrenheit, or colder. Contaminant particulates such as crystals can plug the spray gun, causing inconsistent flow and/or inconsistent blend ratios of the A-part and B-part components. Therefore, it is desirable to solve this problem of plugging and/or blockage of the flow of fluid through the spray gun due to particulate contaminants.

Moreover, it is desirable to solve this problem without having to add any additional elements to the dispensing device.

The present inventors have found a solution to the problem by modifying the force applying element in a dispensing device utilizing a spool valve similar to that described in '259. Notably, the solution is applicable to dispensing devices having one feed channel or multiple feed channels (such as that in '529) so it has applicability beyond the precise dispensing device described in'259. Nonetheless, it is particularly useful in a dispensing device such as that described in '259.

The solution provided in the present invention is a result of redesigning the force applying element so as to have a tortuous path through which fluid must flow as opposed to a straight line flow path through the force applying element. The tortuous path is achieved by blocking fluid flow directly through the force applying element and forcing fluid flow to move radially out from the force applying element and then back in radially in order to pass through the force applying element. Filtering is achieved by creating flow-path spacing along the tortuous path that are only large enough to pass fluid and solid particulates smaller than the spacing along the tortuous path. Particulates having a larger size than the flow-path spacing become trapped in the force applying element rather than traveling further into the dispenser to plug the device downstream. Desirably, the force applying element has a volume within it to collect trapped particulates without immediately plugging the dispensing device.

In a first aspect, the present invention is a fluid dispensing device (10) comprising: (a) a spool valve (30) within a dispenser housing (20), the spool valve comprising a spool (40) within a spool housing (24), the spool housing comprising a spool wall (50) around the spool housing with at least one entrance opening (52) and at least one exit opening (54) defined through the spool wall; (b) an entrance channel (22) in the dispenser housing proximate to the entrance opening in the spool wall; (c) a force applying element (60) within the entrance channel, where the force applying element applies force against the spool wall around the entrance opening, the force applying element being generally cylindrical with opposing entrance (62) and exit (64) ends with the exit end most proximate to the spool wall; and (d) a hose adapter fitting (70) that has opposing entrance (72) and exit (74) ends, where the entrance end extends out from the dispenser housing and the exit end extends into the entrance channel and is in contact with the force applying element, wherein the hose adapter fitting defines a flow passage (76) extending through it from entrance end to exit end; and wherein there is fluid communication all the way through the flow passage of the hose adapter fitting into and through the force applying element and into an entrance opening in the spool wall; and wherein the fluid dispensing device is characterized by the force applying element defining a tortuous flow path through which fluid must travel to go through the force applying element from entrance end through exit end.

The present invention is useful for dispensing fluids such as two-part polyurethane foam formulations.

DETAILED DESCRIPTION OF THE INVENTION

Figure 1:
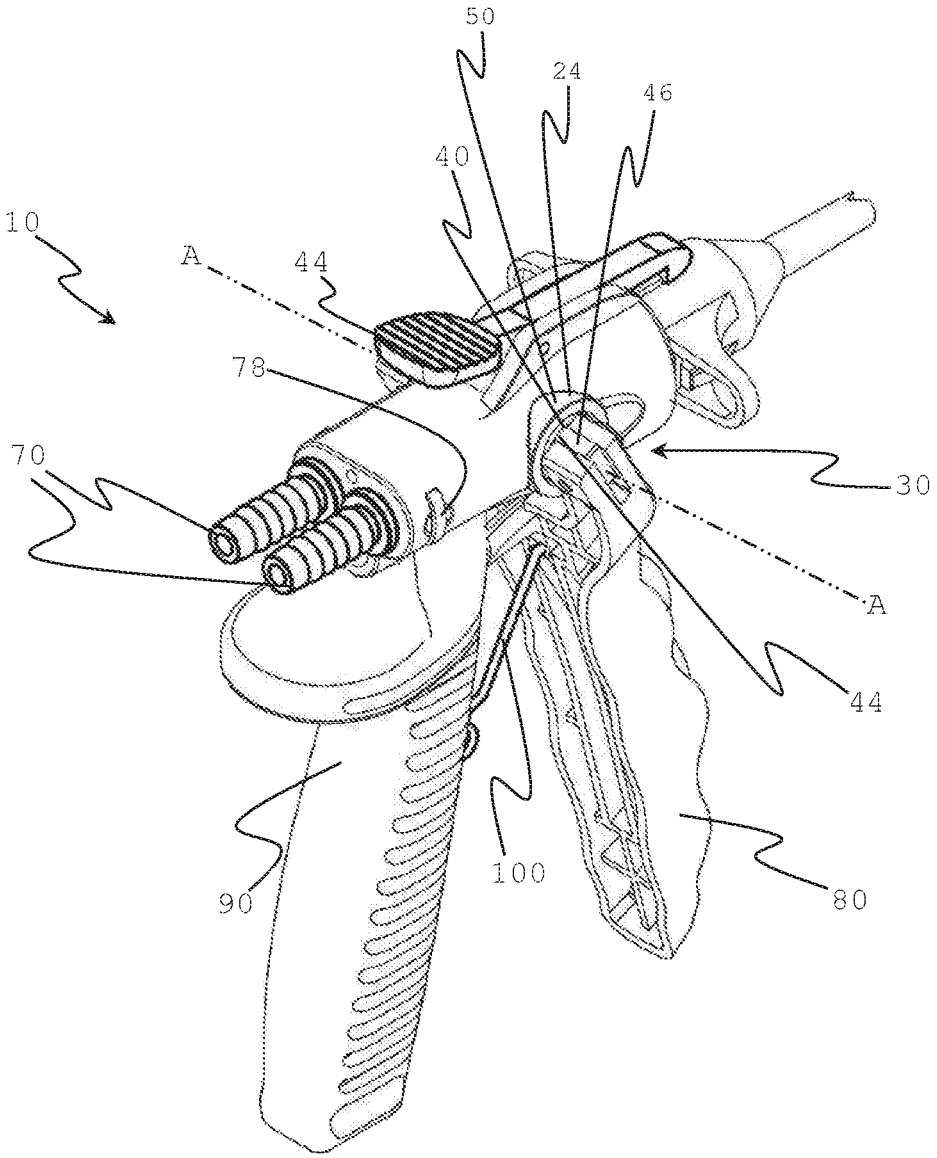
FIG. 1 is an angled side view of a dispensing device of the present invention.
Figure 2:
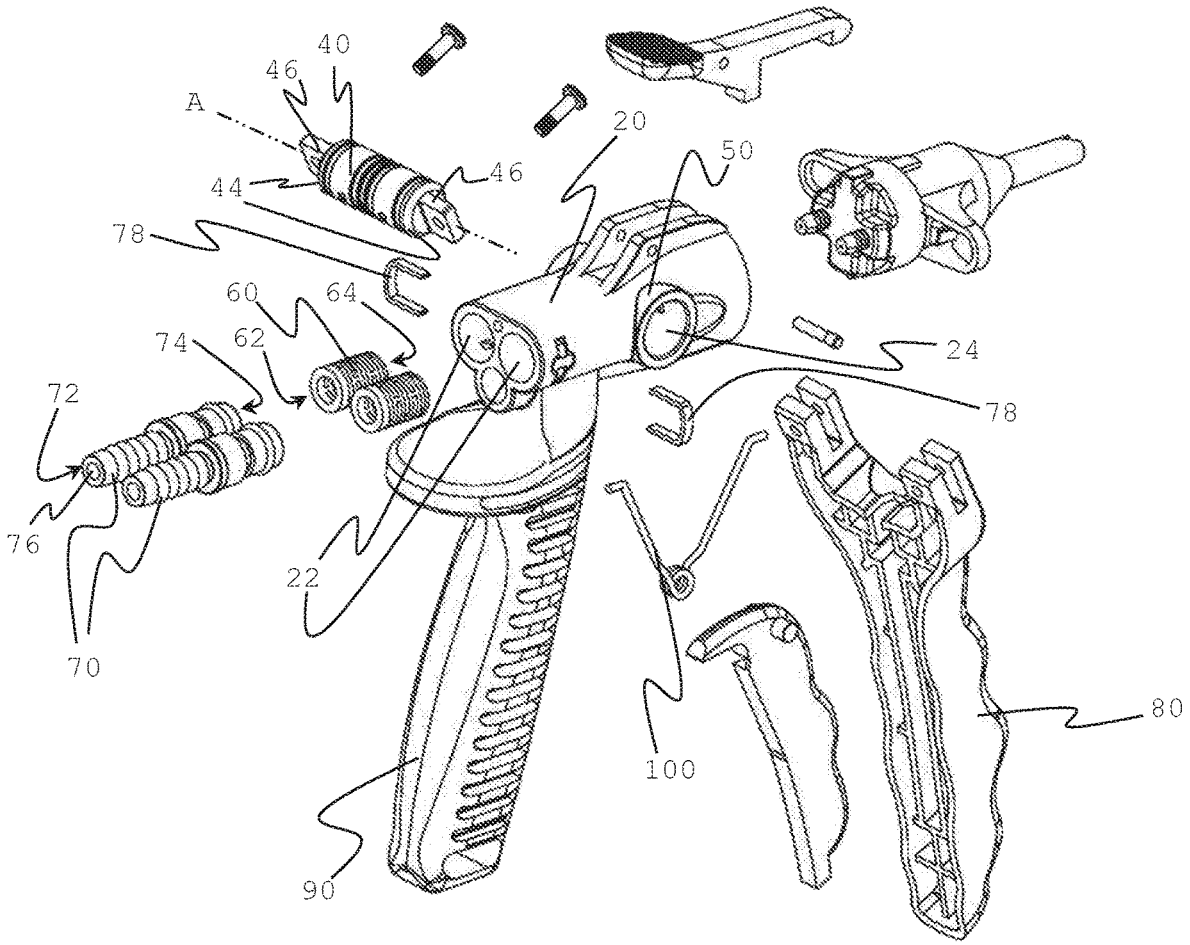
FIG. 2 is an exploded view of the dispensing device of FIG. 1.
Figure 3:
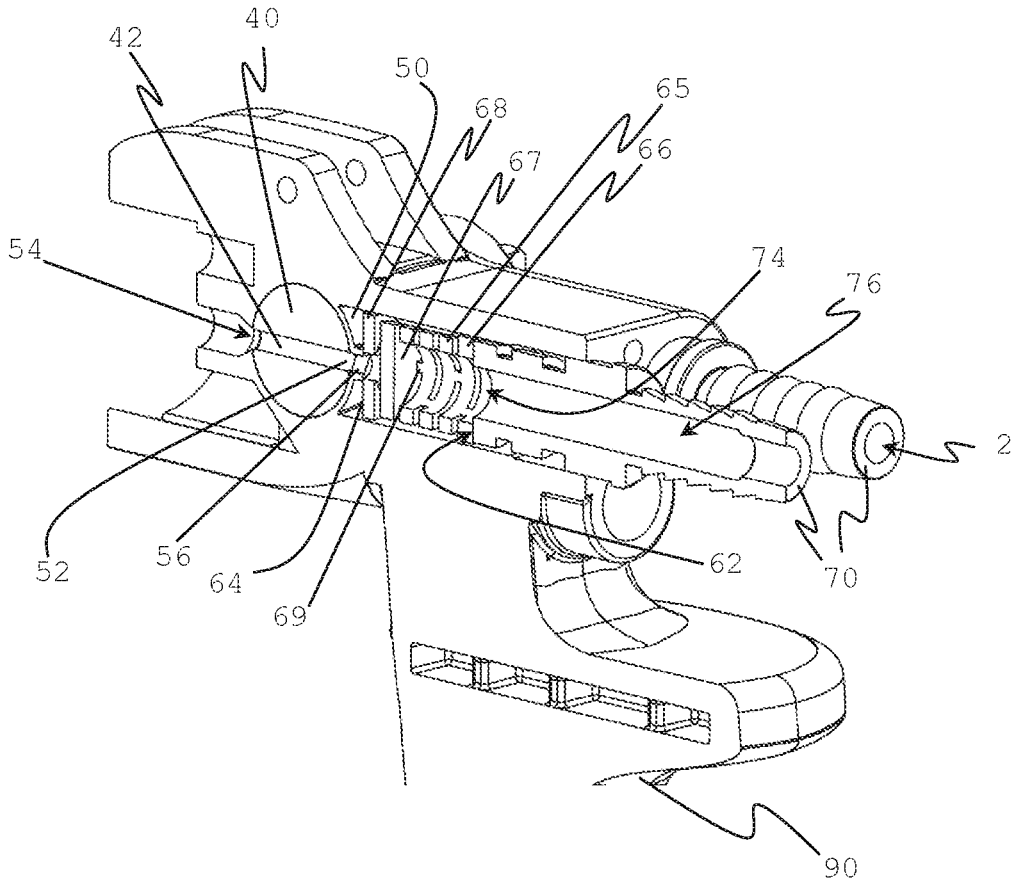
FIG. 3 is a cut-away side view of a dispensing device of the present invention cut through a flow passage of a hose adapter.
Figure 4:
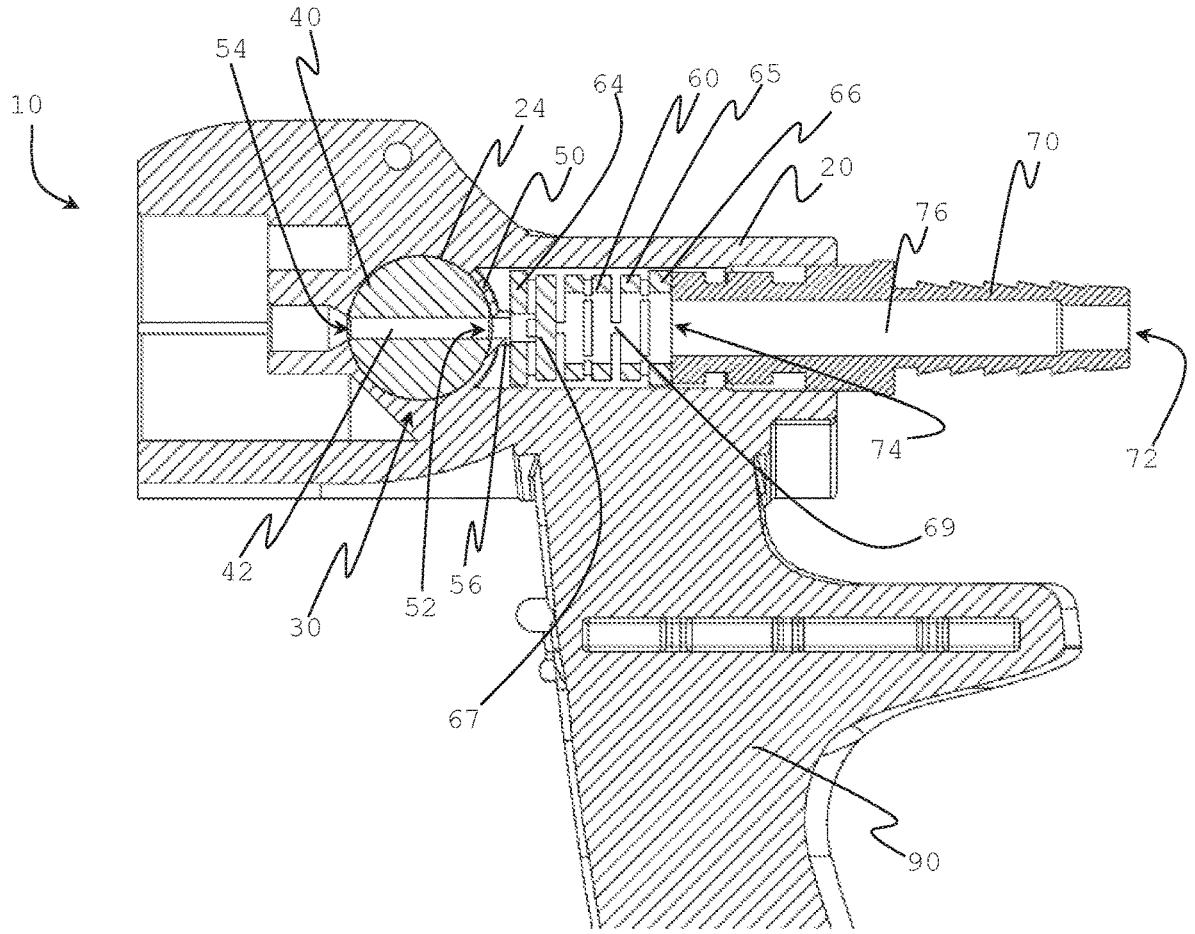
FIG. 4 is another cut-away side view of a dispensing device of the present invention cut through a flow passage of a hose adapter.
Figure 5A:
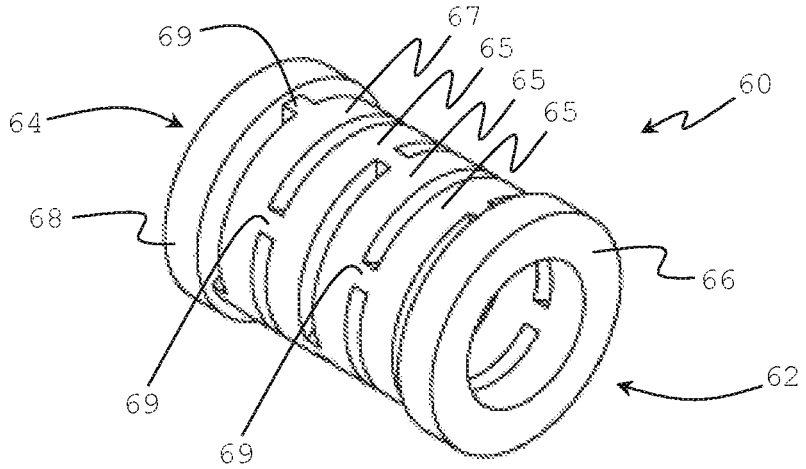
FIG. 5A provides an angled view of a force applying element having a "sequence of plates" design.
Figure 5B:
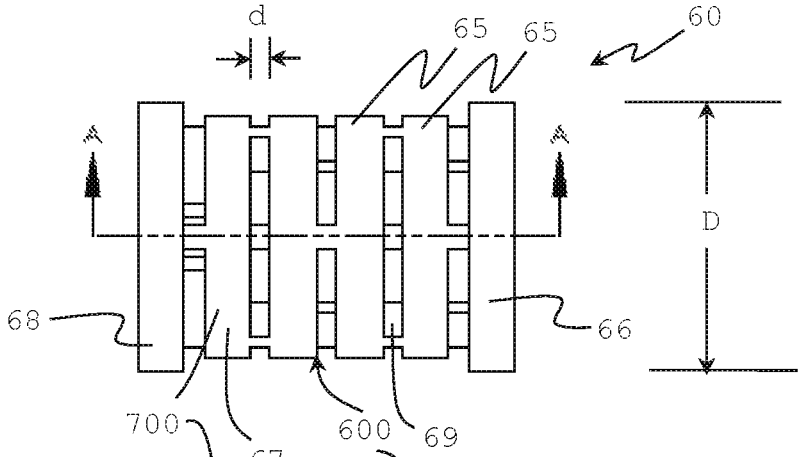
FIG. 5B provides a side view of a force applying element having a "sequence of plates" design.
Figure 5C:
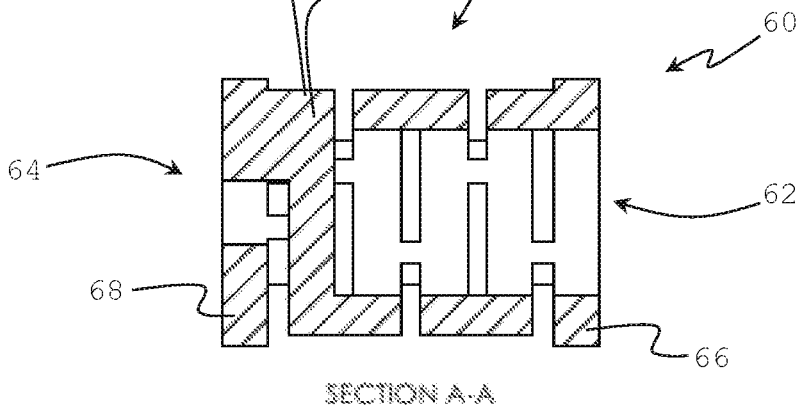
FIG. 5C provides a cut-away side view of a force applying element having a "sequence of plates" design.

All publications mentioned herein are incorporated herein by reference to disclose and describe the methods and/or materials in connection with which the publications are cited.

It is to be understood that the terminology used herein is for the purpose of describing particular aspects only and is not intended to be limiting. Unless defined otherwise, all technical and scientific terms used herein have the same meaning as commonly understood by one of ordinary skill in the art to which this invention belongs. In this specification and in the claims which follow, reference will be made to a number of terms which are defined herein.

"And/or" means "and, or as an alternative". All ranges include endpoints unless otherwise indicated. "Multiple" means two or more.

"Primary surface" refers to the surface of an object that has a planar surface area equal to the largest planar surface area of any surface of the object. A planar surface area refers to the surface area of a surface as projected onto a plane so as to eliminate consideration of surface contours and features such as peaks and valleys in the surface area calculation. Plates, discs and boards have opposing primary surfaces separated by a thickness dimension. "Edges" of a plate, disc or board refer to the surface or surfaces extending around the circumference of the primary faces and along the thickness of the object.

"Diameter" refers to the largest cross sectional dimension of an object and does not imply the object necessarily has a circular cross section.

The present invention can be understood more readily by reference to the following detailed description, examples, drawings, and claims, and their previous and following description.

While the present invention is capable of being embodied in various forms, the description below of several embodiments is made with the understanding that the present disclosure is to be considered as an exemplification of the invention, and is not intended to limit the invention to the specific embodiments illustrated. Headings are provided for convenience only and are not to be construed to limit the invention in any manner. Embodiments illustrated under any heading or in any portion of the disclosure, including the claims, may be combined with embodiments illustrated under the same or any other heading or other portion of the disclosure, including the claims.

Any combination of the elements described herein in all possible variations thereof is encompassed by the invention unless otherwise indicated herein or otherwise clearly contradicted by context.

Unless otherwise expressly stated, it is in no way intended that any method or aspect set forth herein be construed as requiring that its steps be performed in a specific order. Accordingly, where a method claim does not specifically state in the claims or description that the steps are to be limited to a specific order, it is in no way intended that an order be inferred, in any respect. This holds for any possible non-express basis for interpretation, including matters of logic with respect to arrangement of steps or operational flow, plain meaning derived from grammatical organization or punctuation, or the number or type of embodiments described in the specification. It is to be understood that both the foregoing general description and the following detailed description are exemplary and explanatory only and are not restrictive.

The present invention is a dispensing device useful for dispensing pressurized fluid. Desirably, the dispensing device of the present invention is useful for simultaneously dispensing multiple pressurized fluids. In that regard, the present invention provides a device into which one or more than one pressurized fluid is provided and out from which one or more than one fluid is dispensed. A particularly desirable embodiment of the present invention accommodates independently feeding the A-part and B-part of a two part polyurethane foam formulation into the dispensing device of the present invention and then mixing and dispensing of the A-part and B-part to produce a polyurethane foam.

FIGS. 1-6 illustrate embodiments of aspects of the present invention. Reference signs to the elements described below are labeled on the embodiments in the Figures to assist in understanding the invention.

The dispensing device (10) comprises a dispenser housing (20) within which is a spool valve (30). The spool valve controls flow of pressurized fluid through the dispensing device by rotation of a spool between an "open" configuration and a "closed" configuration.

A spool valve comprises a spool (40) situated within a spool housing (24) that is defined by the dispenser housing. The spool housing is defined by a spool wall (50) around the spool housing within which the spool resides. The spool is typically generally cylindrical in shape with opposing ends (44) separated by a straight line axis (A). The spool can alternatively be generally spherical in shape with the straight line axis (A) extending through a diameter of the sphere. The spool resides in the spool housing with the straight line axis of the spool extending across the housing so that the spool can rotate around the straight line axis within the spool housing. The spool defines one or more than one channel (42) extending through the spool, through one point on the curved surface of the spool to another point on the surface of the spool. Generally, there is at least one such channel extending through the spool for each fluid that that is fed through the dispensing device. The spool wall has at least one entrance opening (52) and one exit opening (54) defined therethrough, preferably one entrance and one exit opening for each fluid that is fed through the dispensing device. The spool valve works by actuating the spool into an "open" configuration by rotating it along its straight line axis so as to align the entrance opening through a spool wall with an opening of a channel through the spool and an exit opening through the spool wall with the other opening of the channel through the spool thereby simultaneously providing fluid communication through the entrance opening in the wall, through the spool and through the exit opening in the wall. The spool valve can also be rotated into a "closed" configuration where the entrance and exit openings through spool walls do not simultaneously align with a channel through the spool.

The dispenser housing defines at least one entrance channel (22). Typically, there is an entrance channel for each pressurized fluid that is fed to the dispenser. The entrance channel extends from the spool wall through the dispenser housing to outside of the dispenser housing. The portion of spool wall within a dispensing channel includes an entrance opening defined through that portion of spool wall.

A force applying element (60) resides within the entrance channel, preferably within each entrance channel to which pressurized fluid is to be supplied. The force applying element is generally cylindrical in shape having opposing entrance (62) and exit (64) ends separated by a length. The exit end of the force applying element applies a force against at least a portion of the spool wall within the entrance channel in which the force applying element resides.

The force applying element distinguishes the present dispensing device from other similar dispensing devices. The force applying element of the present invention is free of a straight line path of fluid communication through it. Instead the force applying element defines a tortuous flow path through which fluid must travel to go through the force applying element from entrance end through the exit end. For example, a desirable form of the force applying element allows fluid flow to enter the force applying element through the entrance end generally parallel to the primary axis (length) of the force applying element and then forces fluid flow generally radially from the primary axis (generally perpendicular to the length) and around a barrier before again having to flow generally along the primary axis through the exit end of the force applying element. In contrast, the force applying element of U.S. 944,259 provides a straight line flow path through the force applying element.

In directing the path of fluid flow in a tortuous flow path through the force applying element, the fluid flow is directed through openings of a size that will preclude passage of solid particulates having a larger size than the openings in the force applying element flow path. Hence, the force applying element will serve as a filter for particulates having a larger size than the openings in the tortuous flow path through the force applying element. Desirably, the force applying element has multiple such openings along the tortuous flow path to avoid immediate blockage of flow through the force applying element upon trapping a single particle. It is desirable for there to be a volume of space in which particles can collect when prevented from flowing through a particular opening in the force applying element much like a basket where particles can collect. Such a feature is achievable by designing the force applying element with a hollow core having multiple openings out from the hollow core through which fluid can flow but particulates larger than the openings cannot. The particulates then can collect in the hollow core, which acts as a basket.

The force applying element can comprise an entrance end plate (66) and an exit end plate (68) each having a diameter (D) that is larger than the diameter of the rest of the force applying element. The entrance end plate and exit end plate each have a hole extending all the way through them in the thickness dimension, extending through opposing primary surfaces. A porous basket element (600) which can act as a basket to collect trapped particulates, is desirably attached to both the entrance end plate and exit end plate and extends between the entrance end plate and exit end plate, with the porous basket element spaced apart from the exit end plate. The force applying element can comprise a barrier (700) that prevents linear flow through the entrance end plate through the porous basket element and through the exit end plate but rather forces generally radial flow out from the porous basket element and around the barrier to reach the hole through the exit end plate to exit the force applying element.

One suitable design of a force applying element having a hollow core with openings out from the hollow core is referred to herein as a "sequence of plates" design. A force applying element having a sequence of plates design is illustrated in FIGS. 1-5.

The force applying element having a sequence of plates design comprises a porous basket element comprising a sequence of plates (65) each defining a hole through their thickness and spaced apart by a plate spacing (d) and connected to one another by spacers (69) with their primary surfaces facing one another and aligned sequentially from the entrance end plate to the exit end plate of the force applying element with fluid communication between the plates through the holes they define and radially between the plates. The plates can have any desirable cross sectional shape including circular cross section, elliptical cross, triangular cross section, star-shaped cross section, square cross section and rectangular cross section. The plates can have flat primary surfaces or can have concave, convex or any other contour for the primary surface. The spacers attaching the plates leave space for fluid communication from the hole through plates radially out around the edge of the plates.

Desirably, the spacers attach to primary surfaces of adjacent plates. Preferably, spacers are staggered in alignment along the sequence of plates so that any one plate is free of spacers directly opposite one another on opposing sides of the plate. For example, one desirable configuration is to include three spacers between plates with spacers at 12, 4 and 8 O'clock position on one primary surface of a plate and 2, 6 and 10 O'clock positions on the opposing primary surface of the plate. Spacers in a staggered configuration allow for the plates to flex slightly when under force thereby making the force applying element capable of absorbing excess force applied through the force applying element.

Both the entrance end plate and the exit end plate define a hole all the way through each plate extending through opposing primary surfaces of each plate (that is, through the thickness of the plate). The entrance end plate and exit end plate have a larger diameter (D) than the majority of, preferably all of, the plates in between the entrance end plate and exit end plate. Desirably, the entrance end plate and exit end plate have a cross section that conforms to the size and shape of the cross section of the entrance channel in which the force applying element resides so that the force applying element can be inserted into the entrance channel but has minimal space between the edges of the entrance and exit end plate edges and the dispenser housing around the entrance channel.

A plate proximate to, preferably adjacent to, the exit end plate is a solid plate (67) (that is, a plate free of a hole extending through the thickness of the plate) and serves as a barrier (700) component for the force applying element. The majority of, preferably all of, the other plates in the force applying element define a hole extending through the thickness of the plate. As a result, the sequence of plates making up the force applying element essentially forms a basket with the solid plate serving as the bottom of the basket and the entrance end plate serving as the top of the basket with a brim broader than the diameter of the basket. The space between the plates making up the basket serve as openings in the basket through which fluid can flow radially out from the basket, around the solid plate and radially back between the solid plate and exit end plate and then through the hole in the exit end plate to exit the force applying device. The holes through the plates are larger than the plate spacings. Therefore, particulates will get trapped in the basket if they are larger than the plate spacing of the plates defining the basket. The force applying element of the sequential plate design forces a tortuous fluid flow through it by having fluid enter through the opening in the entrance end plate and travel through the "basket" formed by subsequent plates having a hole therethrough and then forcing radial flow out from the "basket" through plate spacing holes to go around a solid plate and then flow generally radially back into the force applying element to exit the force applying element through the hole in the exit end plate. The hole in the exit plate is in fluid communication with the entrance hole in the spool wall so fluid flow proceeds from the force applying element through the entrance hole in the spool wall.

The force applying element having a sequential plate design can define multiple "baskets" by including one or more additional solid plate into the sequence of plates and separating the solid plates from one another with plates having a hole through their thickness.

Figure 6A:
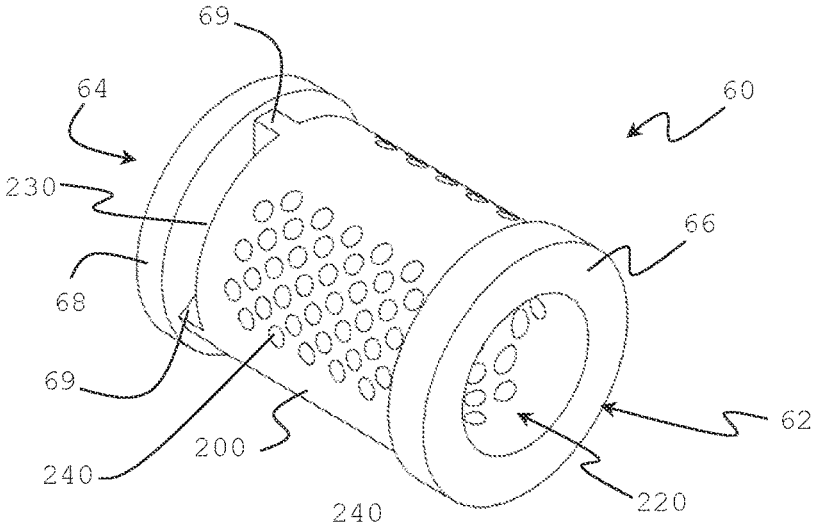
FIG. 6A provides an angled view of a force applying element having a "porous cylinder" design.
Figure 6B:
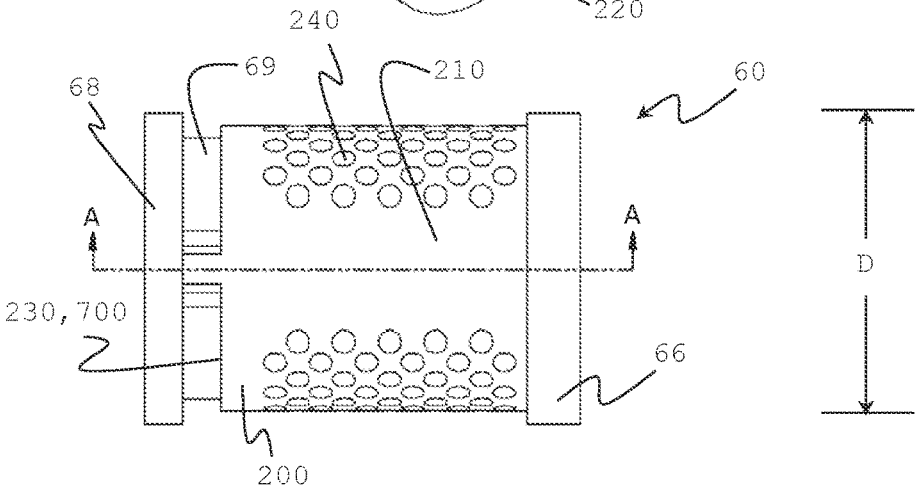
FIG. 6B provides a side view of a force applying element having a "porous cylinder" design.
Figure 6C:
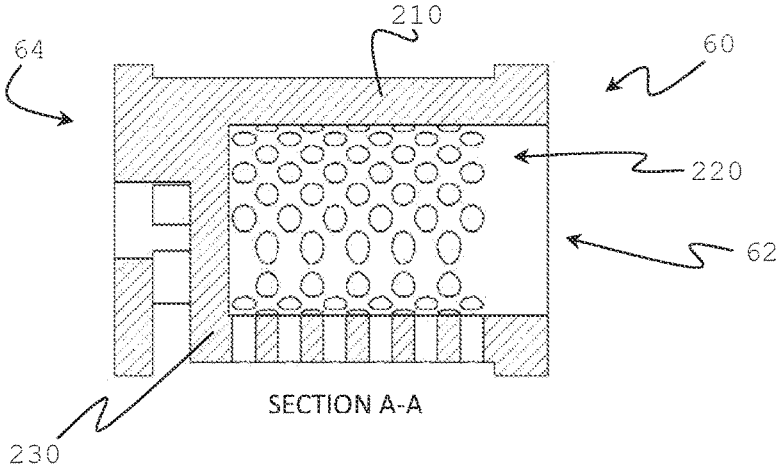
FIG. 6C provides a cut-away side view of a force applying element having a "porous cylinder" design.

Another suitable design of a force applying element having a hollow core with openings out from the hollow core is referred to herein as a "porous cylinder" design. The basket design is generally illustrated in FIGS. 6A, 6B and 6C.

The porous cylinder design is similar to the sequential plate and includes an entrance end plate (66) and exit end plate (68) as described above. The entrance end plate and exit end plate define a hole through their thickness as in the sequential plate design. However, instead of sequential plates with spacings between them serving as the porous basket element, the force applying element has a tubular or cylindrical core (200) with a core wall (210) extending from the entrance end plate towards the exit end plate that defines within it a hollow center space (220) which serves as the porous basket element (600). There is a solid end (230) opposite the entrance end plate on the cylindrical core that serves as the barrier (700). There are multiple holes (240) extending through the core wall providing fluid communication from the hollow center space to outside the cylindrical core. The solid end is attached to the exit end plate with spacers (69) as described above that set the solid end spaced apart from exit end plate and from one another so as to allow fluid communication from outside the cylindrical core to the hole through the exit end plate. A tortuous fluid flow path is required to flow through the porous cylinder design force applying element as fluid enters the force applying element through the hole in the entrance end plate into the hollow center of the core, then radially out through the holes in the core wall around the solid bottom and radially back to the hole through the exit end plate. The size of the holes in the core wall limit the size of particulate than can flow through the force applying element. The hollow core serves as a basket to hold trapped particulates in the force applying element.

The sequential plate design and porous cylinder designs are very similar and can actually be visualized as alternative forms of one another. The sequential plate design is essentially a porous cylinder design with slots for holes through the core wall. Alternatively, the porous cylinder design can be visualized as a sequential plate design with sufficiently sized spacers to fill the plate spacings so as to only leave holes between them. Similar to both designs is: (a) an entrance end plate and an exit end plate each having a larger diameter than the rest of the force applying element and having a hole extending all the way through their thickness; (b) a porous basket element attached to and extending between the entrance end plate and exit end plate; and (c) a barrier that prevents linear flow through the entrance end plate through the basket and through the exit end plate but rather forces generally radial flow out from the porous basket and around the barrier to reach the exit end plate.

Desirably, at least one, and preferably each, entrance opening through the spool wall against which a force applying element applies force has defined therearound a nib (56) extending into the entrance channel from the spool wall that is in contact with the force applying element. Preferably, the exit end plate the force applying element has a hole defined therethrough into which the nib inserts and seals. Such a configuration provides a secure engagement between the spool wall and force applying element that requires flow out from the exit end of the force applying element to flow into the entrance opening through the spool wall.

Desirably, the plate spacing in the sequential plate design and the holes in the porous cylinder design are 0.8 millimeters or less and at the same time 0.1 millimeters or more so as to trap particulates having a size greater than 0.8 millimeters.

The dispensing device further comprises a hose adapter fitting (70) that has opposing entrance (72) and exit (74) ends. The entrance end extends out from the dispenser housing and the exit end extends into the entrance channel and contacts the force applying element. The force applying element and the dispensing device can be a single piece or can be separate pieces. It is desirable for ease of fabrication for the hose adapter fitting and the force applying element to be separate pieces. When separate pieces, the hose adapter fitting desirably presses against the force applying element so as to press the force applying element against the spool wall. The hose adapter fitting defines a flow passage (76) all the way through it, through the entrance end and exit ends. As such, there is fluid communication all the way through the flow passage of the hose adapter fitting into and through the force applying element and into an entrance opening of the spool wall.

It is desirable for the force applying element to press against the spool wall with sufficient force so as to deflect the spool wall against the spool so as to form a fluid-tight seal around the entrance hole proximate to the force applying element and the spool when the spool wall is deflected. The hose adapter fitting can press the force applying element against the spool wall with sufficient force to deflect the spool wall. The hose adapter fitting is typically held in place with a snap or clip to maintain the force. For instance, a metal clip (78) can extend through the dispenser housing and into or around the hose adapter fitting. Additionally, or alternatively, the hose adapter fitting can have one or more protrusion (such as a ring around its perimeter) that snaps into a groove of the dispenser housing within the entrance channel.

The fluid dispensing device can, and desirably does, have multiple entrance channels into which a force applying element as described above and hose adapter fitting reside. When the fluid dispensing device comprises multiple entrance channels with force applying elements and hose adapter fittings the entrance channels desirably feed to a single spool valve having a single spool with multiple channels extending through it. When the spool is in an "open" configuration a different channel desirably lines up in fluid communication with each entrance channel (that is, the fluid path through the hose adapter fitting and force applying element within the entrance channel). When the spool is in a "closed" configuration, it is desirable for channels through the spool to no longer align in fluid communication with the entrance channels containing a force applying element and hose adapter fitting. For example, the fluid dispensing device can have two entrance channels each containing a force applying element and a hose adapter fitting. Such a device is useful for dispensing two-component polyurethane foam compositions by feeding an A-component of the composition through the hose adapter fitting and force applying element in one entrance channel and a B-component of the composition through the hose adapter fitting and force applying element in the other entrance channel.

The fluid dispensing device desirably is trigger actuated. In that regard, it is desirable for the fluid dispensing device to comprise a trigger (80) attached to the spool such that when the trigger is moved in one way the spool rotates into an "open" configuration and when the trigger is moved in a different way the spool rotates into a "closed" configuration. For example, a trigger can attach to one or both ends of the spool through the dispenser housing either by having the trigger having extension that go through holes in the dispenser housing or by having the spool extend out from the dispenser housing. The spool can, for example, have a tab (46) on one or both end along straight line axis A to which the trigger attaches.

Additionally, it is further desirable for the fluid dispensing device to comprise a handle (90), preferably a handle that is attached and remains stationary with respect to the dispenser housing. Such a handle provides a means by which a user can hold the dispensing device. A handle also provides a means against which a trigger can be pulled. The dispensing device can desirably comprise a trigger and a handle as described in addition to a spring device (100) that holds the trigger apart from the handle. Displacing the trigger towards the handle can actuate the spool by rotating it into an "open" orientation. Releasing pressure on the trigger and allowing the spring to displace the trigger away from the handle can actuate the spool and rotate it to a "closed" orientation. Such a spring element can reside between the handle and trigger so that it compresses when the trigger is pulled towards the handle and expands when the trigger moves away from the handle. Suitable examples of such springs, handles and triggers and their configurations suitable for use in the present invention are taught in U.S. Pat. No. 5,944,259 and US2017/0157624.

As an example of a dispenser of the present invention, the dispenser of U.S. Pat. No. 5,944,259 can be modified so as to replace the force applying element taught therein with the force applying element as taught herein.

What is claimed is:

1. A fluid dispensing device (10) comprising:

(a) a spool valve (30) within a dispenser housing (20), the spool valve comprising a spool (40) within a spool housing (24), the spool housing comprising a spool wall (50) around the spool housing with at least one entrance opening (52) and at least one exit opening (54) defined through the spool wall;

(b) an entrance channel (22) in the dispenser housing proximate to the entrance opening in the spool wall;

(c) a force applying element (60) within the entrance channel, where the force applying element applies force against the spool wall around the entrance opening, the force applying element being generally cylindrical with opposing entrance (62) and exit (64) ends with the exit end most proximate to the spool wall, said force applying element consisting of a porous basket element having a sequence of plates design, each plate connected to one another by spacers (69), the sequence of plates spaced between the entrance and exit ends, including a solid plate (67) that serves as a barrier (700) that prevents linear flow and forces radial flow by preventing a straight line flow path through the force applying element, the force applying element having a primary axis, the force applying element forcing fluid flow radially through the force applying element from the primary axis and around the barrier, wherein the force applying element forms a basket to collect particles with the solid plate serving as the bottom of the basket and the entrance end serving as the top of the basket with a brim broader than the diameter of the basket; and (d) a hose adapter fitting (70) that has opposing entrance (72) and exit (74) ends, where the entrance end extends out from the dispenser housing and the exit end extends into the entrance channel and is in contact with the force applying element, wherein the hose adapter fitting defines a flow passage (76) extending through it from entrance end to exit end; and wherein there is fluid communication all the way through the flow passage of the hose adapter fitting into and through the force applying element and into an entrance opening in the spool wall; and wherein the fluid dispensing device is characterized by the force applying element defining a tortuous flow path through which fluid must travel to go through the force applying element from entrance end through exit end.

2. The fluid dispensing device of claim 1, wherein the force applying element is a separate piece from the hose adapter fitting.

3. The fluid dispensing device of claim 1, the device having two or more entrance openings through the spool wall, and separate entrance channels in the dispenser housing opening to one of the entrance openings in the spool wall and each entrance channel having said force applying element and said hose adapter fitting inserted therein.

4. The fluid dispensing device of claim 1, wherein the hose adapter fitting applies force to the spool wall through the force applying element such that the spool wall deflects against the spool when the force is applied.

5. The fluid dispensing device of claim 1, wherein at least one entrance opening through the spool wall has a nib (56) around it that protrudes towards and contacts the force applying element and against which the force applying element applies force to the spool wall.

6. The fluid dispensing device of any one previous claim, wherein the force applying element comprises an entrance end plate (66) and an exit end plate (68) each having a larger diameter (D) than the rest of the force applying element and having a hole extending all the way through their thickness, a porous basket element (600) attached to and extending between the entrance end plate and exit end plate with the porous basket element spaced apart from the exit end plate, and the barrier (700) that prevents linear flow through the entrance end plate through the porous basket element and through the exit end plate forces radial flow out from the porous basket element and around the barrier to reach the hole through the exit end plate.

7. The fluid dispensing device of claim 6, wherein the porous basket element comprises said sequence of plates (65), each defining a hole through their thickness, the plates having primary surfaces and spaced apart by a plate spacing (d) and connected with the primary surfaces of the plates facing one another and aligned sequentially from the entrance end plate to the exit end plate with fluid communication between the plates through the holes they define and radially between the plates, and where the barrier is a solid plate proximate to the exit end plate.

8. The fluid dispensing device of claim 7, wherein the plate spacing between any two plates of the force applying element is 0.8 millimeters or less and at the same time 0.1 millimeters or more as measured between adjacent primary surfaces.

9. The fluid dispensing device of claim 7, wherein the force applying element has said solid plate adjacent to the exit end plate.

10. The fluid dispensing device of claim 8, wherein the force applying element has said solid plate adjacent to the exit end plate.

11. A fluid dispensing device (10) comprising:

(a) a spool valve (30) within a dispenser housing (20), the spool valve comprising a spool (40) within a spool housing (24), the spool housing comprising a spool wall (50) around the spool housing with at least one entrance opening (52) and at least one exit opening (54) defined through the spool wall;

(b) an entrance channel (22) in the dispenser housing proximate to the entrance opening in the spool wall;

(c) a force applying element (60) within the entrance channel, where the force applying element applies force against the spool wall around the entrance opening, the force applying element being generally cylindrical with opposing entrance (62) and exit (64) ends with the exit end most proximate to the spool wall, said force applying element consisting of a porous cylinder with radial holes (240) therethrough and having a solid end (230) that serves as a barrier (700) that prevents linear flow and forces radial flow by preventing a straight line flow path through the force applying element, the force applying element having a primary axis, the force applying element forcing fluid flow radially through the force applying element from the primary axis and around the barrier, wherein the force applying element forms a basket to collect particles with the solid end serving as the bottom of the basket and the entrance end serving as the top of the basket with a brim broader than the diameter of the basket; and (d) a hose adapter fitting (70) that has opposing entrance (72) and exit (74) ends, where the entrance end extends out from the dispenser housing and the exit end extends into the entrance channel and is in contact with the force applying element, wherein the hose adapter fitting defines a flow passage (76) extending through it from entrance end to exit end; and wherein there is fluid communication all the way through the flow passage of the hose adapter fitting into and through the force applying element and into an entrance opening in the spool wall; and wherein the fluid dispensing device is characterized by the force applying element defining a tortuous flow path through which fluid must travel to go through the force applying element from entrance end through exit end.

12. The fluid dispensing device of claim 11, wherein the force applying element is a separate piece from the hose adapter fitting.

13. The fluid dispensing device of claim 11, the device having two or more entrance openings through the spool wall, and separate entrance channels in the dispenser housing opening to one of the entrance openings in the spool wall and each entrance channel having said force applying element and said hose adapter fitting inserted therein.

14. The fluid dispensing device of claim 11, wherein the hose adapter fitting applies force to the spool wall through the force applying element such that the spool wall deflects against the spool when the force is applied.

15. The fluid dispensing device of claim 11, wherein at least one entrance opening through the spool wall has a nib (56) around it that protrudes towards and contacts the force applying element and against which the force applying element applies force to the spool wall.

16. The fluid dispensing device of any one of claims 11-15, wherein the force applying element comprises an entrance end plate (66) and an exit end plate (68) each having a larger diameter (D) than the rest of the force applying element and having a hole extending all the way through their thickness, a porous basket element (600) attached to and extending between the entrance end plate and exit end plate with the porous basket element spaced apart from the exit end plate, and the barrier (700) that prevents linear flow through the entrance end plate through the porous basket element and through the exit end plate forces radial flow out from the porous basket element and around the barrier to reach the hole through the exit end plate.

17. The fluid dispensing device of claim 16, wherein said porous basket element is a cylindrical core (200) extending between and attaching to the entrance plate and exit end plate, where the cylindrical core has a core wall (210) defining a hollow center space within the cylindrical core and having said holes (240) defined therethrough and the solid end (230) opposite the entrance end plate, where the cylindrical core extends off from the entrance end plate with the core walls around the hole defined through the entrance plate so that there is fluid communication through the entrance end plate into the hollow center of the core and with the solid end attached to the exit end plate with spacers (69) that set the solid end spaced apart from the exit end plate; wherein there is fluid communication through a hole in the entrance end plate into the hollow core and out through the holes in the core wall around the solid end and spacers and through a hole in the exit end plate.

18. The fluid dispensing device of claim 17, wherein the holes (240) have a diameter of 0.8 millimeter or less and at the same time 0.1 millimeters or more.

* * * * *